US006908044B2

(12) United States Patent
Rodriguez-Amaya

(10) Patent No.: US 6,908,044 B2
(45) Date of Patent: Jun. 21, 2005

(54) INJECTOR HAVING INWARDLY OPENING VALVES CONNECTED IN SERIES

(75) Inventor: Nestor Rodriguez-Amaya, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 267 days.

(21) Appl. No.: 10/195,994

(22) Filed: Jul. 15, 2002

(65) Prior Publication Data

US 2003/0019956 A1 Jan. 30, 2003

(30) Foreign Application Priority Data

Jul. 16, 2001 (DE) ..... 101 34 529

(51) Int. Cl.[7] ..... F02M 41/16; F02M 39/00; B05B 1/30

(52) U.S. Cl. ..... 239/96; 239/88; 239/533.2; 239/533.3; 239/585.1; 239/585.4; 239/585.5

(58) Field of Search ..... 239/96, 88–91, 239/95, 533.2, 533.3, 533.9, 533.8, 585.1–585.5; 251/129.15, 129.21, 127

(56) References Cited

U.S. PATENT DOCUMENTS

| | | | | | |
|---|---|---|---|---|---|
| 4,071,197 | A | * | 1/1978 | Bailey et al. | 239/533.11 |
| 4,527,737 | A | * | 7/1985 | Deckard | 239/89 |
| 4,986,472 | A | * | 1/1991 | Warlick et al. | 239/88 |
| 5,121,730 | A | * | 6/1992 | Ausman et al. | 123/467 |
| 5,341,783 | A | * | 8/1994 | Beck et al. | 123/446 |

FOREIGN PATENT DOCUMENTS

| | | |
|---|---|---|
| EP | 823 549 | 2/1998 |

* cited by examiner

*Primary Examiner*—Davis Hwu
(74) *Attorney, Agent, or Firm*—Kenyon & Kenyon

(57) ABSTRACT

A fuel injector for fuel injection systems in internal combustion engines. The injector includes a housing in which valves arranged in series are accommodated. One of the valves is actuated by an actuator assigned to the injector. Each of the valves is assigned a controllable control space, each having one inlet. The valves are designed as inwardly opening valves. One of the valves, which may be actuated by the actuator, acts by way of a spring package upon the other of the valves, which is under prestress by a first spring element.

13 Claims, 3 Drawing Sheets

4
29
5
23
7
6
1
2
25
24
26
32
36
23
31
33
28
27
34
42
30
20
35
41
44
39
37
10
40
38
45
20
9
8
13
21
11
12
15
22
14
16
17
18
19
3

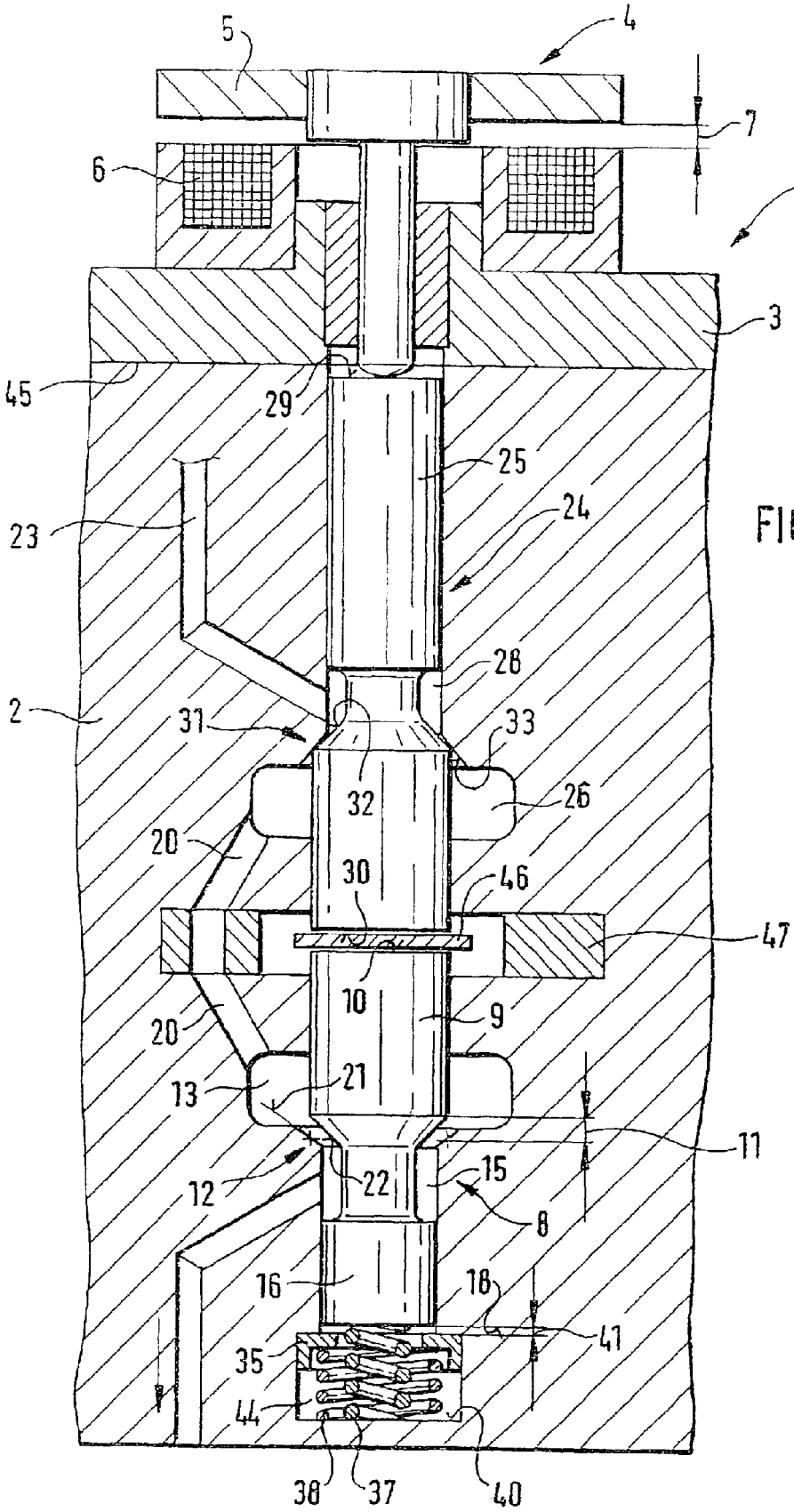
FIG. 1.1

F [N]

6
c3+c2
43
5
c2
4
37
3
c1
19
2
1
0
h1
S [mm]
41
11
h2v
h2
36

INJECTOR HAVING INWARDLY OPENING VALVES CONNECTED IN SERIES

BACKGROUND INFORMATION

Pump nozzle injection systems or pump-line-nozzle injection systems are used in direct injection internal combustion engines. I valves (inwardly opening valves) characterized by a high operating stability may be used in these fuel injection systems. In addition to a high operating stability, shaping of the injection characteristic is also important in order to optimize the course of combustion in the combustion chamber of an engine with regard to formation of carbon black and HC.

European Patent Application No. 823 549 describes an injector. This injector includes an injector body and a nozzle needle displaceably accommodated in the injector body. The nozzle needle is pressed into its seat by a closing spring. A fuel supply line is provided for supplying fuel to the nozzle needle in the area of a conical face so that a force is directed against the action of the closing spring. The connection between the fuel supply line and a drain to the low-pressure area of the fuel injector is controlled by using a drain valve. The fuel pressure in a control space, which is defined in part by an area of the nozzle needle or a component accommodated thereon, is controlled by using a control valve. The nozzle needle or the component accommodated on it is oriented so that a force acting on the nozzle needle is generated at a high pressure level in the control space, supporting the force of the closing spring. The drain valve and the control valve are controlled by an electromagnetic actuator which is designed as a component. The control valve and the end face of the nozzle needle or the component cooperating with it (e.g., a push rod or the like) which form a part of the control space are dimensioned so that the control valve is pressure balanced at all times.

According to this implementation, the drain valve and the control valve are arranged in series on both sides of an electromagnetic actuator, the lifts of the control valve and drain valve being produced simultaneously by the electromagnetic actuator, and independent triggering of the two valves connected in series is impossible.

SUMMARY

With the implementation according to an example embodiment of the present invention, inwardly opening valves (I valves) may be connected in series to an injector in such a way that a shaping of the injection characteristic may be achieved by cross-sectional throttling in an intermediate switch state. This implementation according to the present invention makes it possible to achieve very small lifts with which in turn very small injection quantities may be achieved in certain phases of injection in adaptation to the combustion characteristic taking place in the combustion chamber.

Due to the series connection of two I valves, their two valve needles may be operated using an actuator—be it an electromagnet or a piezoactuator. Between the two valve needles of the series-connected I valves there is a spring package which may include, for example, two spiral springs in a parallel connection. The spring package may be accommodated between the two valve needles of the series-connected I valves, while the valve needle of the I valve at a distance from the actuator is supported by a spring element. The lift of this valve needle is designed to be smaller than that of the valve needle upstream from it. Both valve needles thus close on actuation of the actuator because of the difference in achieving the respective closed positions on the valve needle seats using different lift paths.

Accordingly, the spring package arranged between the valve needles of the first and second I valve acts as a rigid spring in first approximation, so that the spring pretension of the spring element assigned to the first I valve may be overcome in a first actuating movement of the actuator. With a further increase in actuating force by the actuator, a very small lift path may be implemented, depending on the triggering of the actuator, by way of the reserve lift path provided on the second I valve in the area of its valve needle seat, this valve path permitting shaping of the injection characteristic through cross-sectional throttling at the second I valve which takes into account the advance of combustion in the combustion chamber of the engine through metered addition of very small injection quantities. During throttling due to a constriction of cross section at the first I valve, the second I valve downstream from the first I valve as seen in the direction of flow of the fuel remains in its closed position and has no effect on the metering of the fuel volume after closing its valve needle. Metering of fuel is accomplished only through the reserve lift path and its utilization at the second I valve through appropriate triggering of the actuator.

BRIEF DESCRIPTION OF THE DRAWINGS

FIG. 1.1 shows another embodiment of a double-I valve having individual I valves arranged overhead.

DETAILED DESCRIPTION

Figure 1:
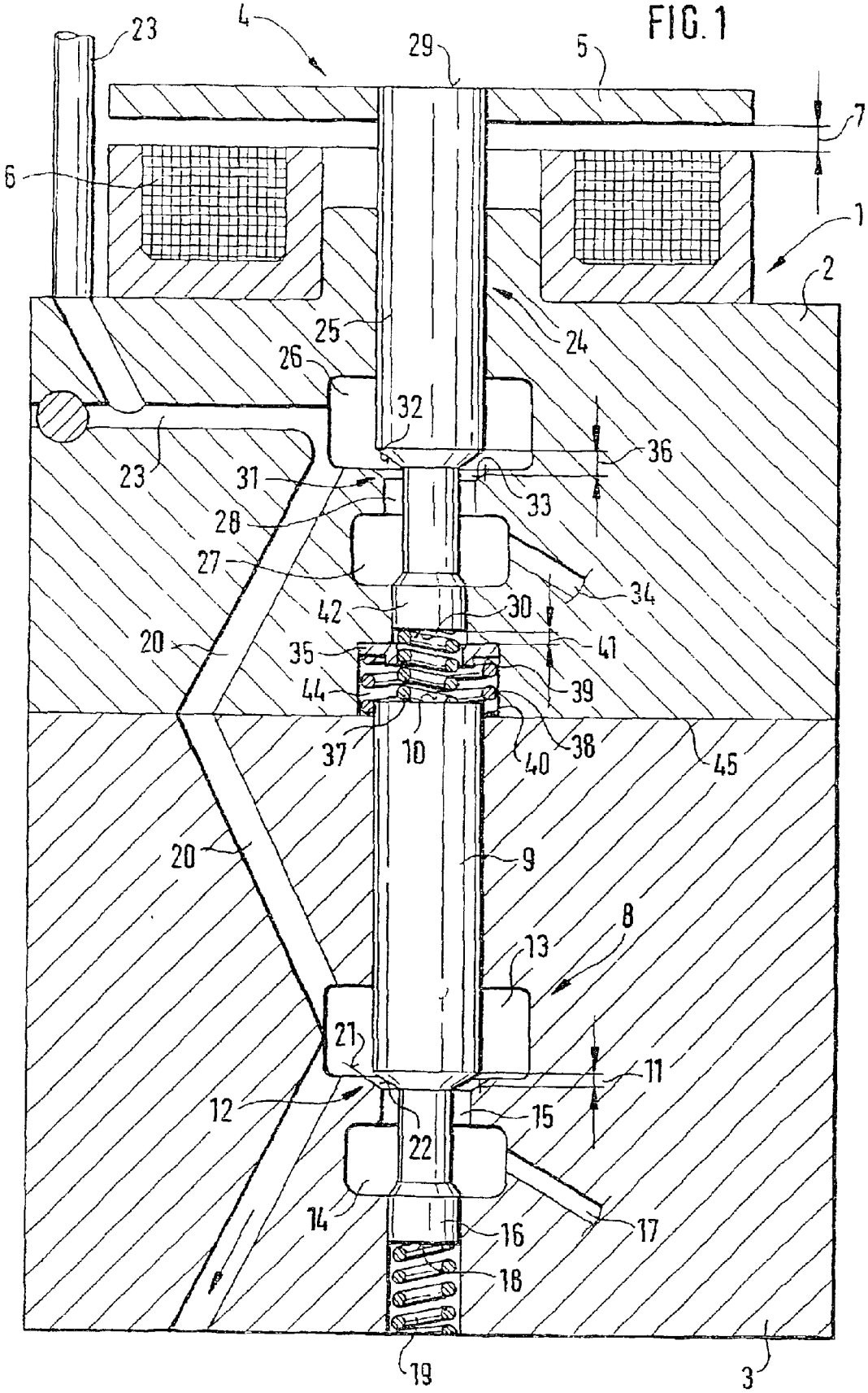
FIG. 1 shows a schematic diagram of a double-I valve having a gradual connection option.

FIG. 1 shows a schematic diagram of a double-I valve having a gradual connection option. In this figure, a fuel injector 1 includes a first housing part 2 and another housing part 3 which are in contact at a joint 45. The two-part design selected here for the injector housing facilitates assembly of inwardly opening valves (I valves) 8 and 24 accommodated in the housing in series. An actuator 4, designed as an electromagnet according to the diagram in FIG. 1, is situated in the upper area of first housing part 2. Actuator 4 includes a plate-shaped element 5 which is accommodated on an upper end face 29 of a second valve needle 25 of second valve 24. A solenoid 6 is situated opposite plate 5. A lift path 7 is provided between plate 5 of actuator 4. On energization of solenoid 6, this lift path 7 is overcome and an actuating movement into second valve needle 25 of second switching valve 24 is initiated.

A first valve needle 9 of first valve 8 (I valve) is inserted into second housing part 3 of fuel injector 1. Valve needle 9 has an upper end face 10 which protrudes into a hollow space 4 in first housing part 2. On the end opposite end face 10, first valve needle 9 is provided with an equalizing piston 16, a first spring element 19 being in contact with its end face 18. First spring element 19 may be designed as a spiral spring and is supported on second housing part 3. First valve needle 9 of I valve 8 is annularly surrounded by a first chamber 13 which may be acted upon by fuel under high pressure through an inlet 20. Beneath first chamber 13, a second chamber 14 is formed in second housing part 3, a pressure relief line 17 branching off from here into the low-pressure area of the fuel injector. A valve needle seat 12 is formed between first chamber 13 and second chamber 14 of first I valve 8. Valve seat 12 of first I valve 8 is formed by a valve seat face 21 on the housing side and a conical section 22, the valve sealing face of first valve needle 9. In the diagram according to FIG. 1, the lift path traveled by first valve needle 9 to reach its closed position on valve needle seat 8 is labeled as 11. An annular gap 15 is provided beneath valve needle seat 12 in second housing part 3 and is in contact with valve needle seat 12 of first I valve 8, connecting first chamber 3 and second chamber 14 of first I valve 8.

Second valve needle 25 of second I valve 24 is accommodated in first housing part 2 of fuel injector 1, plate 5 opposite solenoid 6 being attached to upper end face 29 of the valve needle. Second valve needle 25 is provided with an equalizing piston 42 on the end opposite end face 29 of second needle 25. Second valve needle 25 of second I valve 24 is annularly surrounded by a third chamber 26. In addition, a fourth chamber 27 surrounds second valve needle 25 of second I valve 24 above equalizing piston 42 formed on second valve needle 25. A valve needle seat 31 is formed between third chamber 26 and fourth chamber 27. Valve needle seat 31 ends on the housing side in an annular gap 28, which is closed when second valve needle 25 is closed.

A conical valve sealing face 32 is formed on second valve needle 25, and in the area of valve needle seat 32, it is opposite a valve seat face 33 formed on the housing side, i.e., on first housing part 2. Second valve needle 25 of second I valve 24 travels a lift path labeled as 36 within first housing part 2 of injector 1. Third chamber 26 of the second I valve communicates via an inlet 23 or 20 with a fuel source (not shown here) while fourth chamber 27 of second I valve 24 includes a pressure relief line 34 through which fourth chamber 27 communicates with the low pressure area (not shown here) of fuel injector 1.

A second spring element 37 is accommodated between end face 30 of second valve needle 25 facing first valve needle 9 and end face 10 of first valve needle 9. Second spring element 37 is surrounded by a spring plate 35 configured in the form of a disk inserted into hollow space 44 of first housing part 32. Spring plate 35 is supported with its upper ring face on the border of hollow space 44 in first housing part 2. A third spring element 38 which surrounds second spring element 37 is supported on its lower ring face 39. Spring elements 37 and 38 inserted into hollow space 44 in first housing part 2 in the diagram according to FIG. 1 together form a spring package, which in this case is composed of two parallel spiral springs. Instead of two spring elements 37 and 38 illustrated here, more than two spring elements may also be accommodated in hollow space 44 with appropriate dimensioning of end face 30 and hollow space 44 in first housing part 2. In addition to the design of second spring element 37 and third spring element 38 as spiral springs, it is also possible to have plate spring packages which could be inserted into hollow space 44.

When actuator 4 is triggered by energizing solenoid 6, plate 5, which is accommodated on end face 29 of second valve needle 25, is pulled in the direction of solenoid 6, i.e., the plate lift labeled as 7 is reduced. Due to the insertion movement of second valve needle 25 into first housing part 2, first valve needle 9 of first I valve 8 is also actuated against first spring element 19 which supports it. During the insertion movement of second valve needle 25 into first housing part 2, second spring element 37 of the spring package in hollow space 44, which acts on end face 10 of first valve needle 9 of first I valve 8, functions as a rigid spring in first approximation, so that first valve needle 9 of the first I valve is inserted into its valve needle seat 12 according to its lift path 11 and closes it by its contact with seat faces 21 and/or 22. The rigidity of second spring element 37 is much greater than the spring rigidity of first spring element 19 supporting equalizing piston 16 of first valve needle 9, this spring element in turn being supported in second housing part 3.

During the insertion movement of second valve needle 25 and the closing of first valve needle 9 on its valve needle seat 12 which results from this insertion movement, second valve needle 25 of second I valve 24 is inserted into first housing part 2 over only a portion of its lift path 36. Thus, until reaching a closed position, there is still a reserve lift 41 available at second valve needle 25. When the force on actuator 4 is increased, e.g., through further energization of solenoid 6, its plate 5 travels further toward solenoid 6, thereby applying an increased actuating force on second valve needle 25 of second I valve 24. End face 30 of equalizing piston 42 of second valve needle 25 thus travels toward the inner bore through which second spring element 37 passes, i.e., the edge of the bore until end face 30 of equalizing piston 42 rests on spring plate 35. With a further insertion movement corresponding to the actuating force generated at actuator 4, both the spring force of second spring element 37 as well as the spring force of third spring element 38 supporting spring plate 35 in hollow space 44 then act on second valve needle 25. Depending on the actuating force applied to actuator 4, the throttling applied to second valve needle seat 31 may be varied so that only the smallest quantities of fuel flow out of third chamber 26 of second I valve 24 into inlet 20 toward the nozzle.

The seat cross section which creates the connection of third chamber 26 and chamber 27 depends on the actuating force generatable by actuator 4 and the force of spring package 37 and/or 38 counteracting it in the hollow space of first housing part 2 and the force of spring 19 in the hollow space of bottom housing part 3. With this example embodiment, it is possible to achieve extremely small lift paths with which in turn favorable injection quantity characteristics may be achieved; these may be optimally utilized in the combustion chamber of an engine, depending on the combustion phase prevailing there.

FIG. 1.1 illustrates another example embodiment of an arrangement of a double-I valve inside a housing. An actuator 4, which is designed as an electromagnet, similar to the design in FIG. 1, is arranged in the upper area of a second housing part 3. Actuator 4 includes a plate-shaped element 5 which acts on a thrust bolt. A solenoid 6 is situated opposite plate-shaped element 5. When solenoid 6 is energized, plate-shaped element 5 bridges plate lift 7 toward solenoid 6, so that a vertical upward movement is imposed upon that thrust bolt, which is connected to plate-shaped element 5. This results in an actuating movement of second valve needle 25 of second I valve 24 within first housing part 2. In contrast with the diagram according to FIG. 1, in the example embodiment of FIG. 1.1, first I valve 8, whose first valve needle 9 includes an equalizing piston 16, is supported by a spring package composed of spring elements 37 and/or 38 on its lower end face 18. End face 18 of first valve needle 9 is supported directly by second spring element 37, a spring plate 35 which has been inserted into hollow space 44 being itself supported on its lower side by third spring element 38. Two spring elements 37 and 38 are supported on end face 40 of hollow space 44 in the housing. Valve needle seat 12 of first I valve 8 is designed by analogy with the valve needle seat of first I valve 8 according to the illustration in FIG. 1.

In contrast with the diagram of a double-I valve 8, 24 according to the illustration in FIG. 1, second I valve 24 is oriented in the opposite direction from the first I valve in first housing part 2, i.e., standing on its head. Valve needle seat 31 of the second I valve is designed so it is twisted relative to valve needle seat 31 of second I valve 24 according to the diagram in FIG. 1 in first housing part 2 there. In contrast with the diagram of FIG. 1.1, where the spring package, including second spring element 37 and third spring element 38, is situated between end faces 30 of second I valve 24 and end face 10 of first valve needle 9 of first I valve 8, an element 46 configured in the form of a disk is situated between above-mentioned end faces 30 and 10 of valve needles 25 and 9. This element is designed with a diameter greater than the outside diameter of first and second valve needles 9 and 25. Disk-shaped element 46 which functions as a dividing element is surrounded by space which is bordered by the wall of an inside bore of a ring 47.

Chambers 13 and 26, each being assigned to first I valve 8 and second I valve 24, respectively, may be joined downstream by a bore within the housing accommodating a volume directed out of the two chambers.

Figure 2:
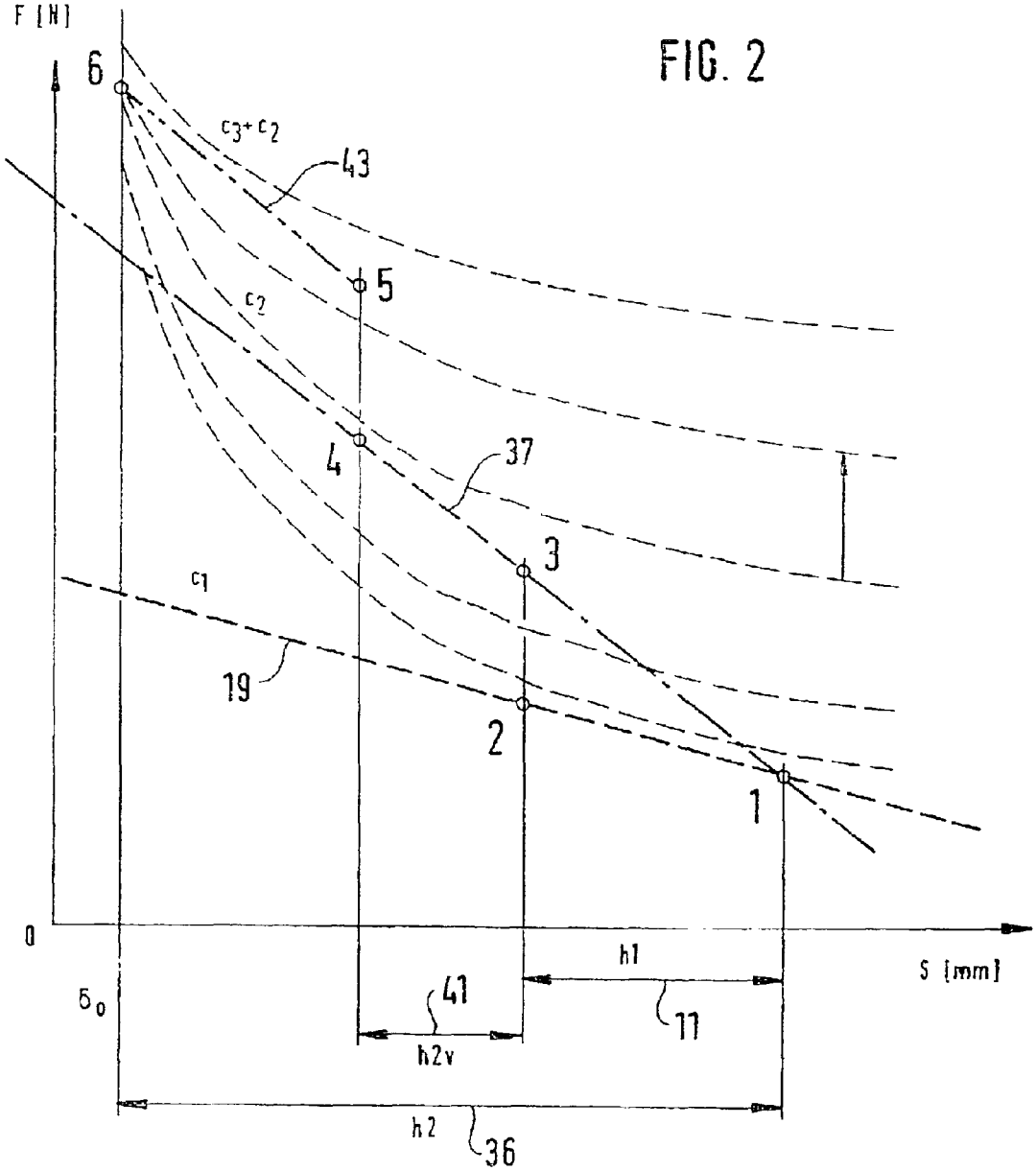
FIG. 2 shows the spring force plotted over the lift path of the I valve(s).

FIG. 2 shows the spring force plotted over the lift paths of the first and second I valves in the housing of the injector which is configured in two parts.

According to the variant embodiment illustrated in FIG. 1, two I valves 8 and 24 are connected in series, their valve needles 9 and 25 being connected by a rigid spring implemented in the form of a spring package, so that both valve needles 9 and 25 are operable with one actuator 4.

Both valve needles 9 and 25 are equipped with different lifts 36 and 11, respectively, the spring elements assigned to these valve springs 9 and 25, i.e., first spring element 19 and second and third spring elements 37 and 38, respectively, in the hollow space 44 of first housing part 2 having different spring characteristics. The first spring element has a spring characteristic $c_1$ which is smaller than spring characteristic $c_2$ of second spring element 37 in hollow space 44. In the valve-open position, first spring element 19 and second spring element 37 of the spring package are under the same prestressing force. This point is labeled as "1" in the diagram according to FIG. 2. On actuation by actuator 4, whether it is a piezoactuator or a solenoid valve, this force acts only on first spring element 19, in simplified terms; second spring element 37 of the spring package in hollow space 44 represents in first approximation a rigid spring. Both valve needles 9 and 25 are moved in the direction of their valve needle seats 12 and 31, respectively. First valve needle 9 of first I valve 8 is the first to reach its valve needle seat 12 and closes it. This point is labeled as 2 in the diagram according to FIG. 2. With a further increase in actuating force by actuator 4 on end face 29 of second valve needle 25, another lift path 41 may be traveled by second valve needle 25 until end face 30 of equalizing piston 42 reaches spring plate 35. Until reaching spring plate 35 in hollow space 44, second spring element 37 acts in accordance with its spring rigidity $c_2$. Lift path 41 thus follows a continuous line 37 running between 3 and 4 in the diagram.

On reaching spring plate 35 which is under prestress by third spring element 38 in hollow space 44, another force level is to be overcome by actuator 4, represented in the diagram as illustrated in FIG. 2 by the continuous line between 4 and 5. After 5 in the diagram, as illustrated in FIG. 2, second spring element 37 and third spring element 38 of the spring package in hollow space 44 act as springs connected in parallel having rigidities $c_2$ and $c_3$, respectively. Finally at point 6, second valve needle 25 of second I valve 24 has moved into its valve needle seat 31 so that second I valve 24 is also in its closed position in first housing part 2.

According to the design of first spring element 19 which acts upon end face 18 of equalizing piston 16 of first valve needle 9 and according to the designs of second spring element 37 between end faces 30 and 10 of first valve needle 9 and second valve needle 25, respectively, and the design of third spring element 38 which acts upon spring plate 35 in the interior of hollow space 44, a very small residual lift path may be established between positions 5 and 6 according to the diagram in FIG. 2 through suitable triggering of the actuator, so that the desired throttling and thus the shaping of the injection characteristic may be achieved in accordance with the progress of combustion in the combustion chamber of an engine. The injection quantity when first I valve 8 is closed depends only on the throttling at valve seat 31 of second valve needle 25 of second I valve 24 in first housing part 2 of fuel injector 1.

What is claimed is:

1. A fuel injector for a fuel injection system of an internal combustion engine, comprising:

a housing; and inwardly opening valves arranged in series and accommodated in the housing, a first one of the valves configured to be actuated by an actuator assigned to the housing, a respective first controllable chamber in the housing being assigned to each of the valves, the first one of the valves configured to act on a second one of the valves via a spring package, the second one of the valves being prestressed by a spring element;

wherein each of the valves includes a valve needle having an equalizing piston, the equalizing piston being situated beneath a second respective chamber assigned to the valve.

2. The fuel injector according to claim 1, wherein the spring package includes a second spring element and a third spring element which are connected in parallel.

3. The fuel injector according to claim 2, wherein the second spring element is situated between an end face of a first one of the valve needles and a lower end face of a second one of the valve needles.

4. The fuel injector according to claim 2, wherein the third spring element surrounds the second spring element and is supported on a housing part and on a spring plate accommodated in a hollow space of the housing.

5. The fuel injector according to claim 4, wherein the second spring element of the spring package acts on end faces of the valve needles, and one end of the third spring element is supported on a housing part and another end of the third spring element is supported on the spring plate.

6. The fuel injector according to claim 1, wherein each of the valves is assigned a respective second chamber in the housing, a valve needle seat being situated between the respective first chamber and the respective second chamber.

7. The fuel injector according to claim 6, wherein a distributor bore opens into each of the respective first chambers of the valves and an outlet bore is provided for each of the respective second chambers of the valves.

8. The fuel injector according to claim 1, wherein the actuator assigned to the housing is controlled independently from the movement of the internal combustion engine.

9. The fuel injector according to claim 1, wherein the actuator assigned to the housing is controlled independently of a revolution of the internal combustion engine.

10. The fuel injector according to claim 1, wherein the actuator assigned to the housing includes an electromagnet actuator.

11. The fuel injector according to claim 1, wherein the actuator assigned to the housing includes a piezo actuator.

12. A fuel injector for a fuel injection system of an internal combustion engine, comprising:

a housing; and inwardly opening valves arranged in series and accommodated in the housing, a first one of the valves configured to be actuated by an actuator assigned to the housing, a respective first controllable chamber in the housing being assigned to each of the valves, the first one of the valves configured to act on a second one of the valves via a spring package, the second one of the valves being prestressed by a spring element;

wherein the first one of the valves has a lift path which is greater than the lift path of the second one of the valves.

13. A fuel injector for a fuel injection system of an internal combustion engine, comprising:

a housing; and inwardly opening valves arranged in series and accommodated in the housing, a first one of the valves configured to be actuated by an actuator assigned to the housing, a respective first controllable chamber in the housing being assigned to each of the valves, the first one of the valves configured to act on a second one of the valves via a spring package, the second one of the valves being prestressed by a spring element;

wherein a prestressing force generated by the spring package is greater than that of the first spring element.

* * * * *